United States Patent [19]

Alsdorf

[11] 4,201,259

[45] May 6, 1980

[54] SECURITY POUCH TO BE CLIPPED TO ARTICLES OF CLOTHING

[76] Inventor: Franz Alsdorf, Amalienstrasse 28, 8000 Münich 40, Fed. Rep. of Germany

[21] Appl. No.: 959,380

[22] Filed: Nov. 9, 1978

[30] Foreign Application Priority Data

Mar. 1, 1978 [DE] Fed. Rep. of Germany ..... 2808348

[51] Int. Cl.[2] ..... A45C 13/18; A45C 13/20

[52] U.S. Cl. ..... 150/47; 150/3; 24/3 G

[58] Field of Search ..... 150/47, 3, 37, 39, 40; 24/3 F, 3 H, 3 T

[56] References Cited

U.S. PATENT DOCUMENTS

| | | | |
|---|---|---|---|
| 2,823,720 | 2/1958 | Sveo et al. | 150/3 |
| 3,846,872 | 11/1974 | Nathan | 24/3 G |

*Primary Examiner*—George T. Hall

*Attorney, Agent, or Firm*—Birch, Stewart, Kolasch and Birch

[57] ABSTRACT

A clip-on holder for coins, keys, cards and the like forms a security pouch which can be fastened on to an article of clothing. The holder comprises a slim flexible portion which defines a pocket, preferably closable by a special pull-apart closure providing for a waterproof engagement, and a clip member which is resilient and grippingly holds the article of clothing. The pouch can be worn inconspicuously and yet is secure. The clip member is preferably a two-part hook-shaped element with the outer part compressing the inner part against the clothing.

13 Claims, 7 Drawing Figures

SECURITY POUCH TO BE CLIPPED TO ARTICLES OF CLOTHING

FIELD OF THE INVENTION

This invention relates to a security pouch in the form of a clip-on holder which is adapted to be fastened to an article of clothing for the safe retention of items such as coins, identification cards and the like. The invention is particularly concerned with a security pouch which will provide a waterproof compartment for items such as those mentioned above which are placed therein.

It is well known that there is often a need to be able to retain certain items securely on one's person, such as keys, money, identity cards, pieces of jewelry, etc., where the items must nevertheless remain readily accessible. There is a particular need for this when travelling, when on vacation, when on the beach, when camping, when shopping, at public gatherings, for children, for water sports and for other kinds of sport. In each case there is a need to be able to keep such items safely on one's person in a comfortable manner without taking up much space. Especially when swimming and when indulging in water sports these items must also be protected against the water.

DESCRIPTION OF THE PRIOR ART

In West German Gebrauchsmuster No. 1,991,653 there is described a waterproof money or jewelery box for men's swimming trunks and ladies' swimming costumes, the box having a lid which can be closed by a press fastening and which is sealed by a rubber seal and also having at the back a fastening in the form of a steel spring hoop. By means of this hoop the box can be fastened to the swimming trunks or to a belt. However, such a holder has the disadvantage that its rigid form impairs the freedom of movement of the person wearing it, the fastening of the box to the costume or belt is not absolutely reliable, and above all it is not easy to gain access to the inside of the box.

West German Gebrauchsmuster No. 1,830,131 describes a waterproof closable container which carries a rubber mount coupled to a base plate in the manner of a lid, the container likewise being designed to be fixed to an article of clothing, for example to a belt. The fastening of the container to the clothing is by way of clips in a manner similar to the arrangement in the aforementioned Gebrauchsmuster. Both these known containers have the disadvantage that in spite of their expensive construction, and consequently their high manufacturing cost, they do not fulfil one essential requirement for their satisfactory use, namely that the above-mentioned items can be held in the container without impairing the freedom of movement of the wearer while yet permitting the container to be worn in an inconspicuous but nevertheless quite secure manner.

SUMMARY OF THE INVENTION

It is an object of the present invention to provide a security pouch in the form of a clip-on holder which can be attached to an article of clothing, which will fully meet the above-mentioned basic requirements of such a holder and which can also be manufactured at reasonable cost.

It is a further object of the invention to provide such a security pouch which includes a waterproof compartment, preferably by the inclusion of simple pressfastening closures.

It is another object of the invention to provide a pouch which can be made substantially from plastics materials, transparent or opaque, such materials enabling low-cost manufacture and having the resilience necessary for gripping an article of clothing.

In accordance with the invention there is provided a security pouch comprising a slim flexible container portion and a resilient clip member fastened thereto and capable of being brought into gripping engagement with an article of clothing.

The pouch or holder of the present invention comprises a slim container portion into which the items to be carried can be introduced, and a resilient clip member formed from shaped cross-section stock to which the container portion is fastened and which can grip the article of clothing. Preferably, the clip member comprises an inner part and an outer part resiliently enclosing the former, the outer part thereby exerting a force on the inner part which stresses it resiliently in the sense to cause it to grip against the article of clothing. Alternatively, the clip member may be formed as a one-piece element or can be formed with flaps which are operated by spring tension or as snap fastenings. Preferably, the clip member is formed from a suitable plastics material which on the one hand has a sufficient rigidity to give adequate support to the container portion and on the other hand has sufficient elasticity to ensure that it reliably grips the article of clothing.

The container portion which holds the items to be carried is preferably formed separately from the clip member from two transparent or opaque sheets of plastics material overlaid on one another and then united by a one-step welding process, the container portion then being secured to the clip member mechanically by means of a stud fastening and/or by the use of an adhesive. If, in accordance with the preferred embodiment, the clip member is a stock section of plastics material, then it can easily be manufactured by an injection moulding process or, with further simplification, by an extrusion process, so that both parts of the pouch can be manufactured at low cost.

According to a preferred embodiment of the invention, a waterproof pull-apart closure is fastened or welded on to the open end of the container portion which may be remote from the clip member so that the pouch can be taken into the water, for example when swimming, without any danger of damaging the contents in it. Because of the slim appearance of the container portion and because of the cross-sectional shape of the clip member one is able to carry the container portion between the body and the article of clothing to which it is attached without it being visible externally, and because of the flexibility of the container portion the freedom of movement of the person wearing the pouch is not impaired.

It is also to be understood that the particular uses and applications of the pouch given herein form part of the subject matter of this invention, but are not to be regarded as the only uses for the pouch.

BRIEF DESCRIPTION OF THE DRAWINGS

In order that the invention may be fully understood, a presently preferred embodiment of security pouch in accordance with the invention will now be described by way of example and with reference to the accompanying drawings in which.

DESCRIPTION OF THE PREFERRED EMBODIMENT

Figure 1:
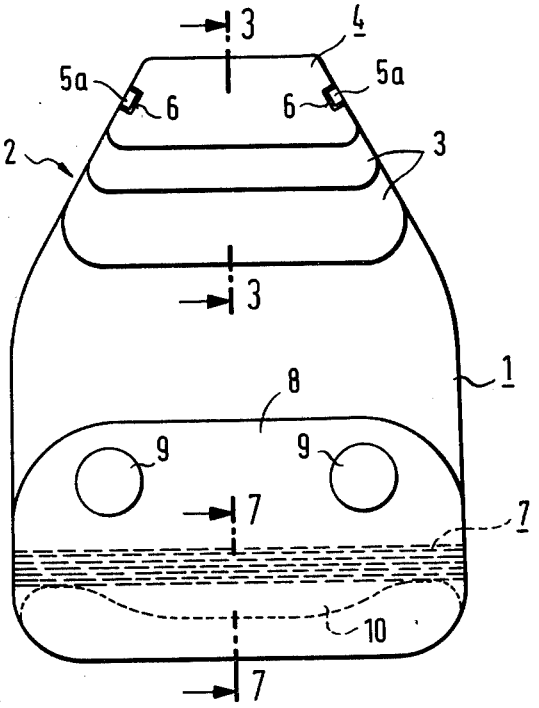
FIG. 1 is an external view of the complete pouch made in accordance with the invention.

The clip-on security pouch, which is shown complete in FIG.1, consists of a container portion 1 and a clip member 2 which can be fastened to it. The container portion 1 is capable of receiving various different items, such as money, keys, identity cards, pieces of jewelery and the like, and in the illustrated preferred embodiment is in the form of a slim substantially rectangular pocket having an upper frusto-conical region 1' which tapers towards the top and which, as can be seen from FIG. 2, extends into a section which is formed as a fastening tongue 11. As can also be seen from FIG. 2, one or more holes 12, in the present case two horizontally spaced holes, are provided in the fastening tongue 11. These holes 12 are arranged to engage with projecting studs **5*b* on an inner part 3 of the clip member 2**, as will be described later.

The container portion 1 preferably comprises two flexible sheets of material suitably cut to shape, with the two pieces being overlaid one on the other and welded or connected in some other way to each other along their two vertical edges which taper towards the top as well as along the upper horizontal terminating edge of the fastening tongue 11. Those parts of the two pieces which form the fastening tongue 11 can, for further reinforcement and strengthening, be fully or partly welded, glued or heat sealed to each other. A particularly suitable material for the container portion 1 is flexible plastics sheet material, such as PVC or polyethylene sheet, which may be either transparent or opaque, although leather, fabric, waterproofed or gummed materials, coated paper and the like can also be used.

As can be seen from FIG. 2 in combination with FIG. 7, the rear wall **1*a* of the container portion 1 extends down below the bottom edge of the front wall 1*b* and is provided at its lower end with a folding flap 8 which in the wrap-around position shown in FIGS. 2 and 7 overlies the external surface of the front wall 1*b* and thus closes off the lower end of the container portion 1. In order to effect a releasable fastening of the flap 8 so that it can be opened from the illustrated closed position, a closure consisting of one or more press studs 9 is provided between the front wall 1*b* of the container portion and the flap 8**.

Figure 2:
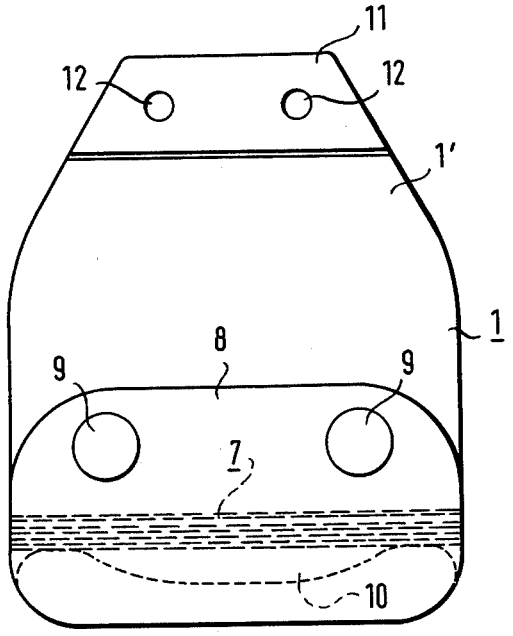
FIG. 2 is a view of the pouch, similar to FIG. 1, but with the clip member removed.
Figure 7:
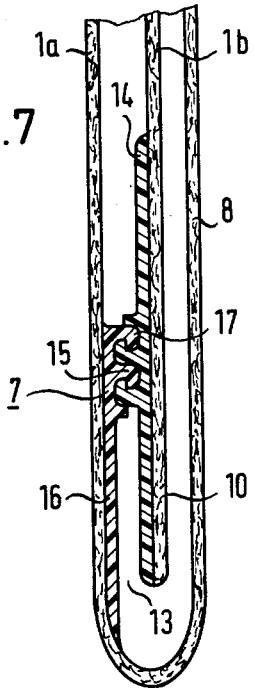
FIG. 7 is a sectional view on an enlarged scale taken along the line 7—7 of FIG. 1.

As can be seen best from FIGS. 2 and 7, in the region of the lower end of the container portion 1, the co-operable parts of a two-part closure 7 are welded or otherwise secured to opposed areas of the internal faces of the rear wall **1*a* and of the front wall 1*b*. Although, the closure 7 can have any suitable structure as deemed desirable, it is preferably formed as a pull-apart fastening and in particular should be of such a construction that the interior of the container portion 1 can be closed off as a watertight compartment. One preferred embodiment of closure 7 which has these properties is shown in detail in FIG. 7. Each part of the two-part closure comprises a welded-on strip 14, 16 by means of which the respective closure elements can be welded on to the inner faces of the front and rear walls 1*b*, 1*a* respectively of the container portion 1. On the external surfaces of the strips 14, 16 which face one another in the welded-on state there are formed one or more snap-fastening elements 15, 17 which are hook-shaped in cross-section so that they can be pressed into interengaging relationship one with another and thereby seal off the lower end of the container portion 1 in a watertight manner. By exerting a pulling apart force on the front wall 1*b*, preferably by means of a tongue-like projection 10 formed at the lower end of the front wall, the hook-shaped elements 15, 17 can be stripped apart out of engagement with each other so that the interior of the container is accessible. It will be appreciated that the closure 7 should extend across the full width of the container portion 1 in order to constitute a watertight closure. Although the provision of a closure 7 as described above is preferably provided in combination with the flap closure 8, 9**, it will also be appreciated that the container portion need only be provided with one of these two closures or can be equipped with a closure of some other form than those described and shown.

In order to be able to clip the container portion 1 on to any given carrier, for example on to the waistband of a pair of trousers, the edge of a swimming costume, a belt, or the breast pocket of a jacket or coat, there is provided the clip member 2 which is shown in FIG. 1 and in FIGS. 3 to 6 and which is connected to the container portion 1 by way of its fastening tongue 11. By means of this clip member 2 the container portion 1 can be securely clipped to any given article of clothing without it being abe to slide off. As can be seen particularly well from FIGS. 3 to 6, the clip member 2 in its preferred form comprises an inner part 2 and an outer part 4 which is fitted over the inner part 3 and which is so formed that it exerts a resililent compressive force on the inner part 3 in order to achieve the desired gripping effect.

Figure 3:
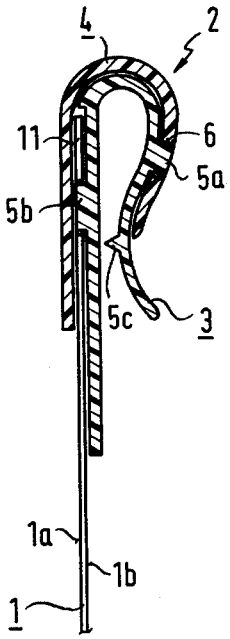
FIG. 3 is a sectional view taken along the line 3—3 of FIG. 1.
Figure 4:
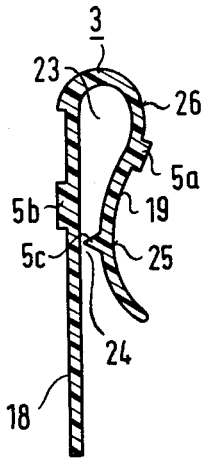
FIG. 4 is a sectional view of the inner part of the clip member shown in FIG. 6.

FIG. 4 shows the inner part of the clip member 2 in section. This inner part preferably has a crooked or hook-shaped cross-section with, in the view shown in FIG. 4, a vertical stem portion 18 and a reversed S-shape curved hook region 19 which is formed as an extension of the upper end of the stem 18 so that it overlies a part of the inner face of the stem 18 (the right-hand face as shown in the drawing), thereby forming a cavity 23 between the hook region 19 and the stem 18. This cavity 23 narrows downwardly from the top and is open at the bottom. At the narrowest part 24 of the cavity, i.e. at the crown of the surface of the lower curve 25 of the hook 19 facing the stem 18 and which curves in the direction towards the stem 18, there is formed a rib-like projection **5*c* which constitutes a further narrowing of the neck of the cavity and which can be pressed firmly against an article of clothing introduced into the cavity. On the face of the upper curve 26 of the hook region 19 which faces away from the stem 18 and which curves away from the stem further studs 5*a* are formed to fasten the inner part 3 to the outer part 4 by press fit engagement of the studs 5*a* in correspondingly shaped apertures 6 in the outer part 4, as can be seen from FIG. 1. On the outer surface of the stem 18** which faces away from the hook region 19 there are formed a number of studs 5b, preferably correspondinng in number to the number of holes 12 in the fastening tongue 11, these studs 5b being arranged so that they can fit into the holes 12 as is shown in FIG. 3. These studs 5b thus secure the fastening tongue 11 in relation to the inner part 3 of the clip member 2 and thus, in combination with the sheath forming the outer part 4 of the clip, effect the attachment of the container portion 1 to the clip member 2. Preferably, the connection is additionally strengthened by the provision of additional glueing of the fastening tongue 11 to the inner part 3 of the clip. Alternatively one can rely just on a glued connection of this type without the provision of the studs 5b and the holes 12 if one wishes.

Figure 6:
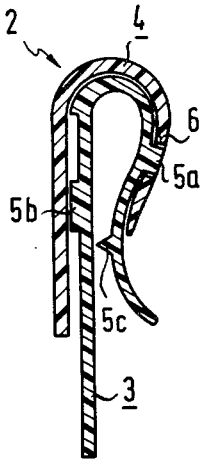
FIG. 6 is a sectional view through the composite clip member.

As can also be seen from FIGS. 3, 4 and 6, the surface of the stem 18 which is in contact with the fastening tongue 11 is recessed to a depth equal to the thickness of the fastening tongue so that when the fastening tongue 11 is secured in place there is a neat transition to the hook region 19 by virtue of the flush fitting.

Figure 5:
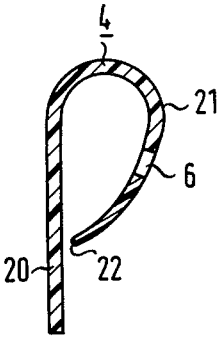
FIG. 5 is a sectional view of the outer part of the clip member shown in FIG. 6.

FIG. 5 shows the resilient outer part 4 which fits over and grips the inner part 3 of the clip 2. This outer part 4 has a profile in cross-section which matches the vertical stem 18 and the upper outwardly curved loop 26 of the hook region 19 of the inner part 3, so that it can clampingly grip these regions from the outside as is shown in FIGS. 3 and 6. The outer part 4 thus includes a vertical stem 20, seen in FIG. 5, which extends at the top into a hook region 21 which is so curved that it extends first outwardly and then inwardly so that the free edge 22 of the hook region 21 comes to lie in close proximity to the adjacent facing surface of the stem 20 and when fitted as a sheath on to the inner part 3 exerts a spring force against the hook 19 of the inner part. At the same time the stem 20 of the outer part 4 presses the fastening tongue 11, which is secured by the studs 5b, against the relevant surface of the stem 18 of the inner part, as can be seen clearly in FIG. 3. As mentioned above, apertures 6 are provided in a suitable part of the hook region 21, preferably at its side edges, into which the studs 5a on the inner part 3 can latch when the parts are fitted together as shown in FIGS. 3 and 6.

FIG. 6 shows the composite clip 2 formed by a combination of the inner part 3 and outer part 4. Suitable materials for the clip 2 are resilient plastics materials, particularly acrylic-, butadiene-, styrene- copolymers, polystyrene, styrene copolymers, polyacrylate, polymethacrylate as well as polyamide. If one wishes, the clip 2 can alternatively be made from a metallic material, for example from steel.

In order to construct the pouch shown in FIG. 1 the bag portion 1 with its fastening tongue 11 is first secured to the fastening surface of the stem 18 of the inner part 3 of the clip with engagement of the projecting studs 5b and/or is glued to this surface. Then, the outer part 4 of the clip is pushed on to the inner part 3 from the side or from the top until there is latching engagement between the projections 5a and the apertures 6. The outer part 4 of the clip then exerts a spring force on the inner part 3, with the result that the spring force bends the hook region 19 in the direction towards the stem 18 so that the edge of an article of clothing pushed into the cavity 23 between the hook region 19 and the stem 18 is held fast by the rib-like projection 5c. Simultaneously, the fastening tongue 11 is finally fixed to the inner part 1 by the fitting of the outer part 4 of the clip.

The pouch described above is used as follows. By bending up the hook region 19 against the spring force exerted by the outer part 4 of the clip the gap at the narrow neck 24 between the stem 18 and the rib-like projection 5c is somewhat enlarged in order that one can introduce the edge of an article of clothing, for example the belt of a pair of swimming trunks. When the hook region 19 is released it springs back into engagement with the edge of the piece of clothing introduced into the gap and thus secures the pouch to the particular article of clothing. Because the pouch has a substantially flat surface on its rear face remote from the hook regions 19, 21 of the clip 2, it can be clipped inconspicuously to the clothing so that the container portion 1 lies between the body and the piece of clothing and only the hook portion of the clip 2 is visible. The hook portion can possibly be provided with decoration or ornamentation or can be shaped in some other way according to fashion. The container portion 1 can be made from transparent or from non-transparent sheet material, as desired.

The pouch of the present invention, particularly when provided with a waterproof closure 7 as shown in FIG. 7, is particularly suited for the safe-guarding of valuables on bathing beaches, when camping, for watersports, and for all other sporting activities. It also offers advantages for travel, folk festivals, when shopping and as a purse for children.

Although a preferred embodiment of the invention has been described above, it should be understood that the invention is not limited to the particular embodiment described. Thus, the container portion 1, instead of having the illustrated shape, can have some other shape with or without the flap 8 as desired for any special purpose. In particular, the container portion 1 can also serve as a holder for an identity card or the like for personal identification, in which case the flap 8 and the closure 7 can possibly be omitted, and instead of the closure 7 a welded seam can be made in order permanently to seal off the inside of the container after the insertion of the identity card or the like. Moreover, the clip 2 need not necessarily be formed in two parts as shown in FIGS. 1 to 6. On the contrary, one can alternatively use a one-piece clip which then preferably would have a structure corresponding to the inner part 3 of the clip shown in FIG. 4 and the necessary spring force would be achieved just by appropriate dimensioning of its hooked region 19.

Moreover, the container portion 1 can be provided with the capacity to float in water, in which case air pockets could be formed in the container portion by the provision of suitably shaped additional welded seams.

I claim:

1. A security pouch for attachment to an article of clothing and for the receipt of articles, especially money, cards and the like, comprising a slim flexible container portion and a resilient clip member fastened thereto and capable of being brought grippingly into engagement with an article of clothing, said clip member comprising an inner member with a substantially hook-shaped cross-section and an outer member which resiliently encloses the inner member and which has a cross-section shaped to exert a compressive force on the inner member.

2. A pouch as claimed in claim 1, in which interengageable fastening means are provided on both the outer and inner members for mutual fastening of said members to each other.

3. A security pouch for attachment to an article of clothing and for the receipt of articles, especially money, cards and the like, comprising a slim flexible container portion and a resilient clip member fastened thereto and capable of being brought grippingly into engagement with an article of clothing, said container portion including a fastening tongue for securement to the clip member, said fastening tongue having holes to receive fastening studs formed on the clip member.

4. A security pouch for attachment to an article of clothing and for the receipt of articles, especially money, cards and the like, comprising a slim flexible container portion and a resilient clip member fastened thereto and capable of being brought grippingly into engagement with an article of clothing, said container portion having a front wall and a rear wall and a flap formed on one of said walls, the flap being foldable around the margin of the other wall to overlap said other wall.

5. A pouch as claimed in claim 4, in which the flap is provided with a press fastening by means of which it can be secured to said other wall.

6. A security pouch for attachment to an article of clothing and for the receipt of articles, especially money, cards and the like, comprising a slim flexible container portion and a resilient clip member fastened thereto and capable of being brought grippingly into engagement with an article of clothing, said container portion including buoyancy means in the form of air pockets.

7. The security pouch for attachment to an article of clothing and for the receipt of articles therein, comprising:

(a) a flexible container portion;

(b) closure means extending across the width dimension of said container portion to define a waterproof compartment within said container portion, said closure means comprising releasable press fastening elements of hook shaped cross-sections; and (c) a resilient clip member secured to said container portion and having a portion thereof adapted to grip an article of clothing.

8. A pouch as claimed in claim 7, in which the clip member comprises an inner member with a substantially hook-shaped cross-section and an outer member which resiliently encloses the inner member and which has a cross-section shaped to exert a compressive force on the inner member.

9. A pouch as claimed in claim 8, in which interengageable fastening means are provided on both the outer and inner members for mutual fastening of said members to each other.

10. A pouch as claimed in claim 7, in which the container portion includes a fastening tongue for securement to the clip member, said fastening tongue having holes to receive fastening studs formed on the clip member.

11. A pouch as claimed in claim 7, in which the container portion has a front wall and a rear wall and a flap is formed on one of said walls, the flap being foldable around the margin of the other wall to overlap said other wall.

12. A pouch as claimed in claim 11 in which the flap is provided with a press fastening by means of which it can be secured to said other wall.

13. A pouch as claimed in claim 7, in which the container portion includes buoyancy means in the form of air pockets.

* * * * *

UNITED STATES PATENT AND TRADEMARK OFFICE

CERTIFICATE OF CORRECTION

PATENT NO. : 4,201,259

DATED : May 6, 1980

INVENTOR(S) : Franz ALSDORF

It is certified that error appears in the above-identified patent and that said Letters Patent are hereby corrected as shown below:

In the section entitled "Foreign Application Priority Data" please make the following change:

Change "2808348" to --2808834--.

Signed and Sealed this

*First* Day of *July 1980*

[SEAL]

*Attest:*

SIDNEY A. DIAMOND

*Attesting Officer*

*Commissioner of Patents and Trademarks*